United States Patent [19]

Warzel

[11] Patent Number: 4,547,019

[45] Date of Patent: Oct. 15, 1985

[54] IN-SITU RECOVERY OF MINERAL VALUES WITH SULFURIC ACID

[75] Inventor: F. Morgan Warzel, Bartlesville, Okla.

[73] Assignee: Phillips Petroleum Company, Bartlesville, Okla.

[21] Appl. No.: 492,278

[22] Filed: May 6, 1983

[51] Int. Cl.[4] ..... E21C 41/14

[52] U.S. Cl. ..... 299/4; 299/5

[58] Field of Search ..... 299/4, 5; 423/17, 18, 423/20

[56] References Cited

U.S. PATENT DOCUMENTS

| | | | |
|---|---|---|---|
| 2,818,240 | 12/1957 | Livingston | 299/4 |
| 4,103,963 | 8/1978 | Espenschied et al. | 299/4 |
| 4,185,872 | 1/1980 | Habib, Jr. | 299/4 |
| 4,312,839 | 1/1982 | Habib, Jr. | 299/5 X |
| 4,376,098 | 3/1983 | Yan | 423/20 |
| 4,410,497 | 10/1983 | Otto, Jr. | 299/5 X |

OTHER PUBLICATIONS

Hausler, R. H., The Oil and Gas Journal, Sep. 18, 1978, pp. 146–154.

*Primary Examiner*—Stephen J. Novosad
*Assistant Examiner*—Bruce M. Kisliuk
*Attorney, Agent, or Firm*—C. F. Steininger

[57] ABSTRACT

In accordance with the present invention, mineral values are recovered from subsurface earth formations containing the same as well as calcium-containing materials by injecting into at least one injection well an aqueous sulfuric acid leach solution adapted to extract such mineral values from the subsurface formation and containing a solubility increasing agent, such as sodium chloride, adapted to significantly increase the solubility of calcium sulfates in water, in an amount sufficient to thus increase the solubility of calcium sulfates in water, contacting the subsurface earth formation with the leach solution for a time sufficient to extract significant amounts of mineral values from the formation and produce a pregnant leach solution containing the thus extracted mineral values and to thus solubilized significant amounts of calcium sulfates and withdrawing the pregnant leach solution from at least one producing well.

11 Claims, 1 Drawing Figure

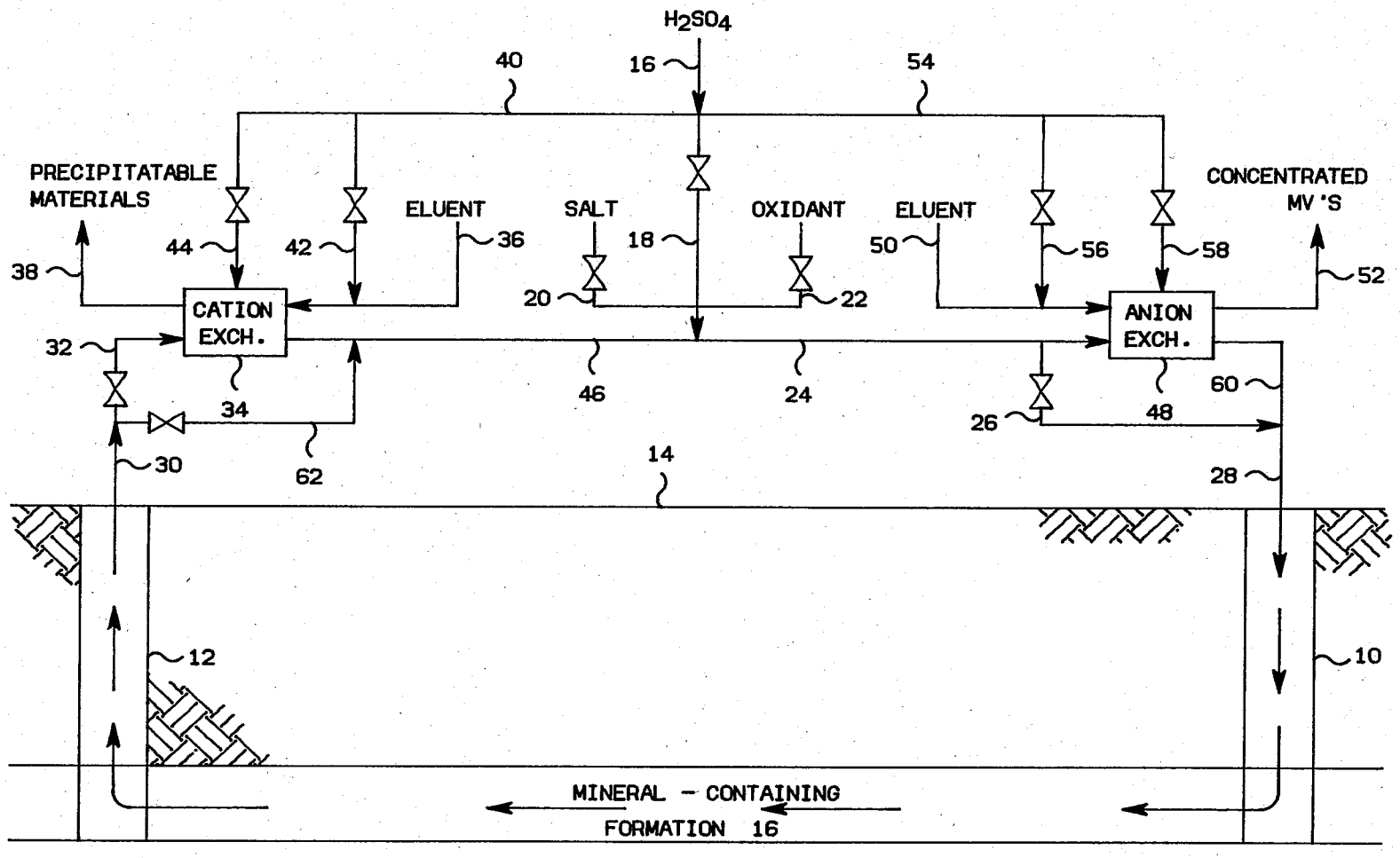
CONCENTRATED MV'S
52
58
ANION EXCH.
48
60
28
10
56
26
54
ELUENT
50
OXIDANT
22
24
$H_2SO_4$
16
18
14
SALT
20
46
MINERAL - CONTAINING FORMATION 16
40
ELUENT
36
42
62
CATION EXCH.
34
44
30
12
PRECIPITATABLE MATERIALS
38
32

IN-SITU RECOVERY OF MINERAL VALUES WITH SULFURIC ACID

The present invention relates to the in-situ recovery of mineral values from subsurface earth formations containing the same. More particularly, the present invention relates to the in-situ recovery of mineral values from subsurface formations containing the same by extraction with sulfuric acid leach solutions.

BACKGROUND OF THE INVENTION

Numerous minerals are present in subsurface earth formations in very small quantities which make their recovery extremely difficult. However, in most instances, these minerals are also extremely valuable, thereby justifying efforts to recover the same. An example of one such mineral is uranium. However, numerous other valuable minerals, such as copper, nickel, molybdenum, rhenium, silver, selenium, vanadium, thorium, gold, rare earth metals, etc., are also present in small quantities in some subsurface formations, alone and quite often associated with uranium. Consequently, the recovery of such minerals is fraught with essentially the same problems as the recovery of uranium and, in general, the same techniques for recovering uranium can also be utilized to recover such other mineral values, whether associated with uranium or occurring alone. Therefore, a discussion of the recovery of uranium will be appropriate for all such minerals.

Uranium occurs in a wide variety of subterranean strata such as granites and granitic deposits, pegmatites and pegmatite dikes and veins, and sedimentary strata such as sandstones, unconsolidated sands, limestones, etc. However, very few subterranean deposits have a high concentration of uranium. For example, most uranium-containing deposits contain from about 0.01 to 1 weight percent uranium, expressed as $U_3O_8$ as is conventional practice in the art. Few ores contain more than about 1 percent uranium and deposits containing below about 0.1 percent uranium are considered so poor as to be currently uneconomical to recover unless other mineral values, such as vanadium, gold and the like, can be simultaneously recovered.

There are several known techniques for extracting uranium values from uranium-containing materials. One common technique is roasting of the ore, usually in the presence of a combustion supporting gas, such as air or oxygen, and recovering the uranium from the resultant ash. However, the present invention is directed to the extraction of uranium values by the utilization of aqueous leaching solutions. There are two common leaching techniques for recovering uranium values, which depend primarily upon the accessibility and size of the subterranean deposit. To the extent that the deposit containing the uranium is accessible by conventional mining means and is of sufficient size to economically justify conventional mining, the ore is mined, ground to increase the contact area between the uranium values in the ore and the leach solution, usually less than about 14 mesh but in some cases, such as limestones, to nominally less than 325 mesh, and contacted with an aqueous leach solution for a time sufficient to obtain maximum extraction of the uranium values. On the other hand, where the uranium-containing deposit is inaccessible or is too small to justify conventional mining, the aqueous leach solution is injected into the subsurface formation through at least one injection well penetrating the deposit, maintained in contact with the uranium-containing deposit for a time sufficient to extract the uranium values and the leach solution containing the uranium, usually referred to as a "pregnant" solution, is produced through at least one production well penetrating the deposit. It is the latter in-situ leaching of subsurface formations to which the present invention is directed.

The most common aqueous leach solutions are either aqueous acidic solutions, such as sulfuric acid solutions, or aqueous alkaline solutions, such as sodium carbonate and/or bicarbonate.

Aqueous acidic solutions are normally quite effective in the extraction of uranium values. However, as detailed hereinafter, aqueous acidic solutions generally cannot be utilized to extract uranium values from ore or in-situ from deposits containing high concentrations of acid-consuming gangue, such as limestone. While some uranium in its hexavalent state is present in ores and subterranean deposits, the vast majority of the uranium is present in its valence states lower than the hexavalent state. For example, uranium minerals are generally present in the form of uraninite, a natural oxide of uranium in a variety of forms such as $UO_2$, $UO_3$, $UO.U_2O_3$ and mixed $U_3O_8$ ($UO_2.2UO_3$), the most prevalent variety of which is pitchblende containing about 55 to 75 percent of uranium as $UO_2$ and up to about 30 percent uranium as $UO_3$. Other forms in which uranium minerals are found include coffinite, carnotite, a hydrated vanadate of uranium and potassium having the formula $K_2(UO_2)_2(VO_4)_2.3H_2O$, and uranites which are mineral phosphates of uranium with copper or calcium, for example, uranite lime having the general formula $CaO.2UO_3.P_2O_5.8H_2O$. Consequently, in order to extract uranium values from subsurface formations with aqueous acidic leach solutions, it is necessary to oxidize the lower valence states of uranium to the soluble, hexavalent state.

Combinations of acids and oxidants which have been suggested by the prior art include nitric acid, hydrochloric acid or sulfuric acid, particularly sulfuric acid, in combination with air, oxygen, sodium chlorate, potassium permanganate, hydrogen peroxide and magnesium perchlorate and dioxide, as oxidants. However, the present invention is directed to the use of sulfuric acid leach solutions containing appropriate oxidants and other additives, such as catalysts.

In addition to the previously mentioned value of in-situ leaching of mineral values, where conventional mining of the ore is impossible or impractical, such leaching has numerous additional advantages. In-situ leaching eliminates the need for handling large tonnages of material, requires a minimum of surface installations and eliminates the need for disposing of final waste products, the last of which is particularly advantageous in the leaching of uranium. In addition, in more populated areas, in-situ leaching eliminates possible objections to undesirable open pits or structures. However, in-situ leaching is not without problems. Certain criteria must be met before an ore body may be considered suitable for in-situ leaching. Of particular importance are the characteristics of the surrounding strata. The ore should preferably be underlain by nonporous rock and should not be surrounded by badly fractured or channelled structures, any of which may lead to serious losses of leaching solution. Cement grouting or the use of special plastics or gels have been proposed as a means of sealing off possible areas of leakage. In addition, solution losses may be controlled to a certain extent by proper placement and usage of inlet and outlet wells. Such placement of injection and production wells may be any of the patterns commonly utilized in enhanced recovery of oil from subsurface earth formations. For example, there are the usual "five-spot" patterns in which four production wells are located at the corners of a square area and a single injection well is located in the center of the square. Other similar patterns are also known. A particularly useful pattern for the recovery of mineral values is one in which the injection wells are located at the corners of a hexagonal area and a single larger production well is located in the center. Techniques for completing the wells, i.e., casing, cementing and perforating, etc., locating the wells, controlling the flow of fluids through the formation, preventing loss of fluid to thief formations, improving areal sweep, etc. are well known to those skilled in the art of in-situ recovery of mineral values and particularly to those skilled in the art of enhanced oil recovery and therefore, the details of such techniques need not be set forth herein.

In addition to the previously mentioned problems of injection, flow through and production from a subsurface formation, additional problems in the in-situ recovery of mineral values from subsurface formations result from the character of the mineral-containing formations themselves. This is particularly true when sulfuric acid leach solutions are utilized.

Certain gangue constituents and other minerals present in mineral-containing formations often have more influence over the process selection than do other factors. Such gangue materials or minerals include calcium carbonate, usually present as calcite or limestone formations, calcium, magnesium carbonate originating in dolomite formations and certain clays, such as montmorillonite clay, magnesium carbonate present as magnesite, ferric carbonate (usually occurring as a mixture of ferric carbonate, ferric hydroxide and ferrous hydroxide), ferrous and ferric sulfides and free iron, the iron compounds generally occurring in most types of subsurface formations in varying quantities. Among the problems resulting from the presence of these gangue or mineral materials are excessive consumption of leach chemicals, substantial increases in the time required to recover the mineral values, plugging of the subsurface formation by the formation of insoluble precipitates, particularly when utilizing sulfuric acid leach solutions, utilization of a significant portion of the capacity of ion exchange materials (when such materials are utilized for the recovery of mineral values from leach solutions), plugging of ion exchange agents (where solid ion exchange agents are utilized) and generally a detrimental effect on the exchange capacity of ion exchange agents and a slowing down of the ion exchange processes and other obvious problems. Since most of these problems result from the precipitation of these materials in aqueous solutions and the present invention is directed in one primary aspect to the prevention of such precipitation, these materials will be referred to herein as "precipitate-forming cations" or "cations which form precipitates with sulfuric acid".

The most troublesome precipitate-forming cation is calcium. The calcium usually in the form of calcium carbonate, calcium, magnesium carbonate etc. will consume acid from an acidic leach solution directly in a ratio of about one pound of sulfuric acid per pound of calcium carbonate that may be present in the subsurface formation. It is generally considered that calcium in amounts of about ten to fifteen percent can be tolerated by acidic leach solutions but if more than fifteen percent calcium carbonate is present, acid cost would be prohibitive. In addition to consuming large quantities of acid, calcium carbonate also results in the previously mentioned problem of precipitation and plugging of a subsurface earth formation during in-situ recovery. This is due to the fact that the reaction of sulfuric acid on calcium carbonate is to form calcium sulfate which has an extremely low solubility in water. Calicum sulfate is soluble in water up to about 2 grams per liter or 0.2% by weight of water, more specifically, less than 1.6 grams per liter or 0.16% by weight of water. Consequently, once a sulfuric acid leach solution contains this amount of calcium sulfate, any further reaction of the sulfuric acid with the calcium carbonate to form calcium sulfate results in the formation of solid precipates which tend to plug the formation and result in reducing the exchange capacity of ion exchange agents and the plugging of solid ion exchange agents. This is further complicated by the fact that, when leach solutions are normally flowed through the subsurface earth formation, the leach solution containing the mineral values is treated at the surface of the earth to remove the mineral values from the leach solution and the leach solution is thereafter recycled one or more times through the formation to obtain optimum mineral value recovery. Accordingly, if the subsurface formation contains substantial amounts of calcium carbonate, the leach solution becomes saturated with calcium sulfate on the first pass through the formation and, therefore, during the second or subsequent passes through the formation, little further reaction of the sulfuric acid with the calcium carbonate is needed to cause the precipitation of calcium sulfate. Therefore, the only known technique in the prior art designed to overcome this problem, in the in-situ leaching of subsurface formations with sulfuric acid leach solutions, is to start with a sulfuric acid solution containing 1.0 to 1.5 grams of sulfuric acid per liter of leach solution or about 0.1 to 0.15 weight percent sulfuric acid in the leach solution. This leach solution is then circulated through the subsurface formation until all of the calcium carbonate has been reacted or neutralized, usually indicated by breakthrough or detection of acid in the leach solution produced from the producing well. Thereafter the concentration of acid in the leach solution is increased, for example, up to about 5 grams per liter or 0.5 weight percent. The obvious disadvantages of this technique include the large consumption of acid, as well as the increase in time necessary to carry out the process.

SUMMARY OF THE INVENTION

It is, therefore, an object of the present invention to provide and improved method for recovering mineral values from materials containing the same which overcomes the above-mentioned and other problems of the prior art. A further object of the present invention is to provide an improved method for recovering mineral values from subsurface earth formations containing the same by in-situ extraction. Another and further object of the present invention is to provide an improved method for the recovery of mineral values from subsurface earth formations containing the same wherein a leach solution adapted to solvate such mineral values is injected into the subsurface formation and the leach solution containing significant amounts of mineral values is then withdrawn. A still further object of the present invention is to provide an improved method for the in-situ leaching of mineral values from subsurface formations utilizing sulfuric acid leach solutions. A further object of the present invention is to provide an improved method for the in-situ leaching of mineral values from subsurface formations with sulfuric acid leach solutions which permits the utilization of higher concentrations of acid. Another and further object of the present invention is to provide an improved method for the in-situ leaching of mineral values from subsurface formations which prevents problems associated with the formation of precipitates by the action of sulfuric acid on calcium-containing materials. A still further object of the present invention is to provide an improved method for the in-situ leaching of mineral values from subsurface formations which significantly reduces the time required for leaching. Yet another object of the present invention is to provide an improved method of in-situ leaching of mineral values from subsurface formations which results in improved recovery of mineral values and/or higher concentrations of mineral values in product concentrates. Another and further object of the present invention is to provide an improved method for the in-situ recovery of uranium from subsurface formations having any or all of the above-mentioned objectives. These and other objects of the present invention will be apparent from the following description.

In accordance with the present invention, mineral values are recovered from subsurface earth formations containing the same as well as calcium-containing materials by injecting into at least one injection well an aqueous sulfuric acid leach solution adapted to extract such mineral values from the subsurface formation and containing a solubility increasing agent, such as sodium chloride, adapted to significantly increase the solubility of calcium sulfates in water, in an amount sufficient to thus increase the solubility of calcium sulfates in water, contacting the subsurface earth formation with the leach solution for a time sufficient to extract significant amounts of mineral values from the formation and produce a pregnant leach solution containing the thus extracted mineral values and to thus solubilized significant amounts of calcium sulfates and withdrawing the pregnant leach solution from at least one producing well.

BRIEF DESCRIPTION OF THE DRAWING

The single FIGURE of the drawing is a schematic flow diagram of a system for the recovery of mineral values from a subsurface formation in accordance with the present invention.

DESCRIPTION OF THE PREFERRED EMBODIMENTS

As previously pointed out, in the introductory portion hereof, the use of sulfuric acid to extract mineral values from subsurface formations which also contain calcium materials, such as calcium carbonates, is quite limited and, in those cases in which sulfuric acid can be utilized in such formations, the prior art has resorted to the time-consuming technique of initially injecting a sulfuric acid leach solution having an extremely low sulfuric acid content such that the solubility limit of calcium sulfates in water, specifically, 0.2194 g/100 ml or 2194 ppm, is not exceeded and, this weak solution is recycled through the formation until essentially all of the calcium carbonate has been neutralized and thereafter the strength of the sulfuric acid leach solution is increased to that conventionally utilized for the extraction of mineral values. This is obviously a time-consuming operation and is not economically feasible in many cases.

In accordance with the present invention this problem is overcome and full strength sulfuric acid leach solution can be utilized from the very outset of the operation by adding to the sulfuric acid leach solution a solubility-increasing agent adapted to significantly increase the solubility of calcium sulfates in water, such as salts capable of increasing the solubility of calcium sulfates in water, particularly chlorides and still more particularly, alkali metal chlorides, such as sodium chloride, barium chloride, lithium chloride, etc. For example, the solubility of calcium sulfate in water is about 0.2194 g/100 ml or 2,194 ppm. Accordingly, a sulfuric acid solution containing 0.1581% by weight or 1,581 ppm of sulfuric acid would produce a saturated solution of calcium sulfate. Therefore, until such time as substantially all of the reactive calcium-containing materials have been washed out of the formation, a sulfuric acid leach solution above this concentration should be avoided in order to prevent precipitation of calcium sulfate in the formation and the surface facilities such as solid ion exchange agents utilized to recover mineral values, i.e. uranium, from a pregnant leach solution. This, of course, is a practice followed by the prior art. However, if a solubility increasing agent is added in accordance with the present invention, the acid concentration from the outset may be substantially increased and in fact, raised to the optimum values normally utilized in in-situ leaching of uranium (about 0.5% by weight sulfuric acid). By way of example, if about 10 to 20 grams per 100 ml (100,000 to 200,000 ppm) of sodium chloride is added to an aqueous solution, the solubility of calcium sulfate can be increased to about 0.7 grams per 100 ml or 7,000 ppm at about 75° F. Obviously, this is greater than three times the solubility in water containing no salt. Accordingly, if salt, in the amounts specified above, are added to a sulfuric acid leach solution, the concentration of sulfuric acid can be approximately tripled without exceeding the solubility limits of the aqueous solution. Above the amounts indicated, the solubility of calcium sulfate in water decreases slightly. The solubility of calcium sulfate in soldium chloride solution is also dependent to some extent upon temperature. Specifically, solubility increases to a maximum at about 112° F. and then decreases to a value substantially equal to that at 32° F. at a temperature of 212° F. However, this reduction at low and high temperatures is comparatively small. As a matter of fact, if about 2 g/100 ml or 2,000 ppm of salt is added under these conditions, the solubility of calcium sulfate in the aqueous solution is increased to about 0.45 g/100 ml or 4,500 ppm. This small amount of sodium chloride, thus, more than doubles the solubility of calcium sulfate in aqueous solution. Accordingly, the concentration of salt in the sulfuric acid leach solution may be any amount sufficient to significantly increase the solubility of calcium sulfate in aqueous solutions, for example above about 1.0 g/ml or 1,000 ppm, preferably in the range of about 10 g to 20 g/100 ml or 100,000 to 200,000 ppm or higher.

In addition to increasing the solubility of calcium sulfate in aqueous solutions, the salt also has the additional effect of increasing the solubility of calcium carbonate in aqueous solutions. For example, the solubility of calcium carbonate in aqueous solution is about 0.0053 g/100 ml or 53 ppm at about 75° F. If under these conditions 12.5 g/100 ml or 125,000 ppm of sodium chloride is added to the aqueous solution, the solubility of calcium carbonate in the solution can be increased to about 0.022 g/100 ml or 220 ppm. While this is a small amount of calcium carbonate which would be dissolved by the solution containing salt, it is significant and, to the extent that calcium carbonate, as such, is dissolved in the salt-containing leach solution, consumption of sulfuric acid to thus convert calcium carbonate to calcium sulfate would be reduced, thus resulting in a saving of the expensive acid and permitting more solubilization of mineral values by the acid than would normally occur. In the case of calcium carbonate, the solubility decreases as the temperature increases, but again, is not enough to offset the increase due to the presence of the salt.

The concentration of sulfuric acid in the leach solution utilized throughout the operation, particularly from the outset if the solubility increasing agent, could be above about 0.16 wt. percent and may be as high as 20 wt. percent. Preferably, however, it is in the neighborhood of 0.5 wt. percent. The sulfuric acid leach solution also necessarily includes an oxidant, which is well known to those skilled in the art and examples of which are set forth in the introductory portion hereof. The leach solution may also contain a catalyst, the nature and type of which are also well known to those skilled in the art.

The present invention will be further understood by the following description when read in conjunction with the drawing.

In accordance with the drawing, an injection well 10 and a production well 12 are drilled from the surface of the earth 14 into and through the mineral-containing formation 16. While only a single injection well and a single production well are shown in the drawing, it is to be understood that any number of injection and production wells may be utilized and such injection and production wells may be aereally oriented and spaced in conventional patterns or any other pattern adapted to attain optimum contact of the subsurface earth formation with the injected fluids. Likewise such injection and production wells would be completed and equipped in accordance with conventional practice known to those skilled in the art.

A sulfuric acid leach solution is introduced to the system through lines 16 and 18. The salt may be added at any point, for example, through line 20, as can the oxidant or oxidant plus catalyst, as through line 22. The leach solution then passes through lines 24 and 26 to line 28 from which it is injected into injection well 10. The leach solution then passes through the mineral-containing formation 16, where it solubilizes significant amounts of the calcium-containing materials, in addition to leaching or solubilizing mineral values. The pregnant leach solution, also containing solubilized calcium-containing materials, is produced through production well 12 and withdrawn through line 30. Preferably, the leach solution is at least initially passed through line 32 and solubilized cations, particularly calcium is removed from the pregnant solution. In accordance with the system illustrated in the drawings, the removal of the solubilized cations is performed by a cation exchange unit 34, which is preferably a solid cation exchange agent. However, any other means of removing the cations, such as a liquid cation exchange agent, may be utilized. Suitable cation exchange agents are well known to those skilled in the art. At such time as the exchange capacity of cation exchange unit 34 is exhausted, for example, as indicated by breakthrough of calcium, exchange unit 34 is removed from service and an eluent is introduced through line 36, passed through the cation exchange unit and spent eluent containing calcium cations is withdrawn through line 38. When a liquid cation exchange material is utilized, this step is generally referred to as stripping, whereas, in the case of a solid cation exchange material, it is referred to as elution. The prior art sometimes refers to this step as regeneration. However, this terminology will be avoided herein, since the cation exchange material often will become poisoned and the removal of such poisons is preferably referred to as regeneration. In any event, suitable stripping or eluent agents are well known in the art. For example, the eluent material may be sulfuric acid introduced through lines 40 and 42. This sulfuric acid is preferably a very dilute solution of the same. Likewise, a solution of sulfuric acid may be introduced through line 44 for the regeneration, i.e. removal of poisons from the cation exchange material. Eluent or regeneration solutions can obviously be further processed to remove precipitatable materials therefrom and reused if desired. The pregnant leach solution, which has been freed of a significant portion of the cations, particularly calcium, is discharged from cation exchange unit 34 through line 46 and is passed through line 24 to anion exchange unit 48. As is the case with cation exchange unit 34, anion exchange unit 48 may be a liquid anion exchange unit or one containing a solid anion exchange agent, both of which are well known in the art. Also, as previously pointed out with relation to exchange unit 34, when the anion exchange capacity of unit 48 has been reached, an eluent may be introduced through line 50, passed through the anion exchange unit and discharged through line 52. The eluent containing mineral values removed from the formation is then treated further for the recovery of the mineral values in accordance with well known procedures. Suitable eluent materials are well known to those skilled in the art and include sulfuric acid, as introduced through lines 54 and 56. Other known eluent materials include nitrate and chloride solutions, for example ammonium nitrate, nitric acid, sodium chloride in combination with sulfuric acid, ammonium chloride or sodium chloride in combination with hydrochloric acid or sulfuric acid, etc. Also, as was the case with the regeneration of the cation exchange unit 34, sulfuric acid introduced through line 58 may be utilized as a regeneration agent. Rather than utilizing single cation and anion exchange units, as shown in the drawing, a preferable procedure is to utilize a plurality of ion exchange units, for example one carrying out ion exchange, a second being eluted and a third on standby, or one performing ion exchange, a second being eluted, a third being regenerated and a fourth on standby. This of course will permit essentially continuous operation. The leach solution from which the mineral values have been recovered is then passed through lines 60 and 28 and reinjected into injection well 10. The leach solution may have additional fresh sulfuric acid, salt, oxidant or oxidant and catalyst added thereto prior to recycling. The solution containing salt may be recycled any number of times necessary to remove substantially all of the calcium ions from the formation. This will generally be indicated by the fact that the fluids produced through line 30 will have the same pH as the injected fluids. Once substantially all of the calcium has been solubilized and removed, the leach solution, withdrawn through line 30, may then be passed through line 62, lines 46 and 24 to anion exchange unit 48. At this point, there obviously, is no advantage in adding additional salt to the leach solution and the leaching of mineral values from the formation may be carried out conventionally until substantially complete removal of mineral values from the formation is attained.

While specific materials, items of equipment and modes of operation, are set forth above, it is to be understood that these specific recitals are by way of example and to set forth the best mode of operation in accordance with the present invention, and are not to be considered limiting and that various modifications, equivalents and variations will be apparent to one skilled in the art without departing from the present invention.

I claim:

1. A method for recovering mineral values from a subsurface earth formation, containing calcium-containing materials in addition to such mineral values, comprising (a) injecting into at least one injection well an aqueous sulfuric acid leach solution adapted to extract a significant amount of mineral values from said subsurface formation and containing a chloride salt, adapted to significantly increase the solubility of calcium sulfates in water, in an amount sufficient to thus increase the solubility of calcium sulfates in water;

(b) contacting said subsurface formation with said leach solution for a time sufficient to extract significant amounts of mineral values from said subsurface formation and produce a pregnant leach solution containing the thus extracted mineral values and to thus solubilize significant amounts of calcium sulfates and remove significant amounts of calcium from said subsurface formation; and (c) withdrawing said pregnant leach solution from at least one producing well.

2. A method in accordance with claim 1 wherein the chloride salt is an alkali metal chloride.

3. A method in accordance with claim 2 wherein the chloride salt is sodium chloride.

4. A method in accordance with claim 1 wherein the chloride salt is present in the leach solution in amounts greater than about 1.0 part per million.

5. A method in accordance with claim 4 wherein the chloride salt is present in the leach solution in amounts of at least about 100,00 ppm.

6. A method in accordance with claim 1 wherein the leach solution contains sulfuric acid in amounts between about 0.16 and 20% by wt.

7. A method in accordance with claim 6 wherein the leach solution contains sulfuric acid in amounts of about 0.5% by wt.

8. A method in accordance with claim 1 wherein calcium ions present in the pregnant leach solution and mineral values present in said pregnant leach solution are removed at the surface of the earth and the resultant leach solution is recycled through the subsurface formation.

9. A method in accordance with claim 8 wherein the calcium ions and the mineral values are removed from the pregnant leach solution by means of ion exchange.

10. A method in accordance with claim 8 wherein the removal of calcium ions from the pregnant leach solution is discontinued at such time as insignificant amounts of calcium ions are present in the pregnant leach solution and the removal of mineral values from the pregnant leach solution is continued.

11. A method in accordance with claim 1 wherein the mineral values are uranium values.

* * * * *